US008191392B2

(12) United States Patent
Kikkawa

(10) Patent No.: US 8,191,392 B2
(45) Date of Patent: Jun. 5, 2012

(54) ROLL, ROLLING MILL AND ROLLING METHOD

(75) Inventor: Tenehiro Kikkawa, Yokohama (JP)

(73) Assignee: JP Steel Plantech Co., Kanagawa-ken (JP)

( * ) Notice: Subject to any disclaimer, the term of this patent is extended or adjusted under 35 U.S.C. 154(b) by 663 days.

(21) Appl. No.: 12/227,119

(22) PCT Filed: May 1, 2007

(86) PCT No.: PCT/JP2007/059337

§ 371 (c)(1),
(2), (4) Date: Feb. 26, 2009

(87) PCT Pub. No.: WO2007/129650

PCT Pub. Date: Nov. 15, 2007

(65) Prior Publication Data

US 2009/0217728 A1 Sep. 3, 2009

(30) Foreign Application Priority Data

May 9, 2006 (JP) ..... 2006-130560

(51) Int. Cl.
*B21B 39/20* (2006.01)
*B21B 31/18* (2006.01)
*B21B 29/00* (2006.01)

(52) U.S. Cl. ..... 72/252.5; 72/247; 72/241.8

(58) Field of Classification Search ..... 72/241.8, 72/247, 252.2, 252.5; 492/1; 700/154
See application file for complete search history.

(56) References Cited

U.S. PATENT DOCUMENTS 4,781,051 A * 11/1988 Schultes et al. ..... 72/247
4,955,221 A * 9/1990 Feldmann et al. ..... 72/247
5,655,397 A * 8/1997 Satoh et al. ..... 72/241.8

FOREIGN PATENT DOCUMENTS

JP 8276205 A 10/1996
JP 9216005 A 8/1997

* cited by examiner

*Primary Examiner* — Edward Tolan
*Assistant Examiner* — Mohammad I Yusuf
(74) *Attorney, Agent, or Firm* — Bacon & Thomas, PLLC

(57) ABSTRACT

[PROBLEMS]
To provide a roll, a rolling mill and rolling method capable of not only effectively correcting the plate crown of a material to be rolled but also reducing the edge drop and preventing a roll from damage caused by the increase of the local line pressure between the rolls.
[MEANS FOR SOLVING PROBLEMS]
A roll crown is formed by a continuous curve having a local maximum point and a local minimum value point where the central region held between the local maximum point and the local minimum point represents one function and the end region from the local maximum point to the nearer roll end represents another function having an inclination of steeper gradient (or having a radius decreasing more sharply toward the roll end) than that of the extension of the function in the central region.

14 Claims, 6 Drawing Sheets

Fig. 1 [New Art]
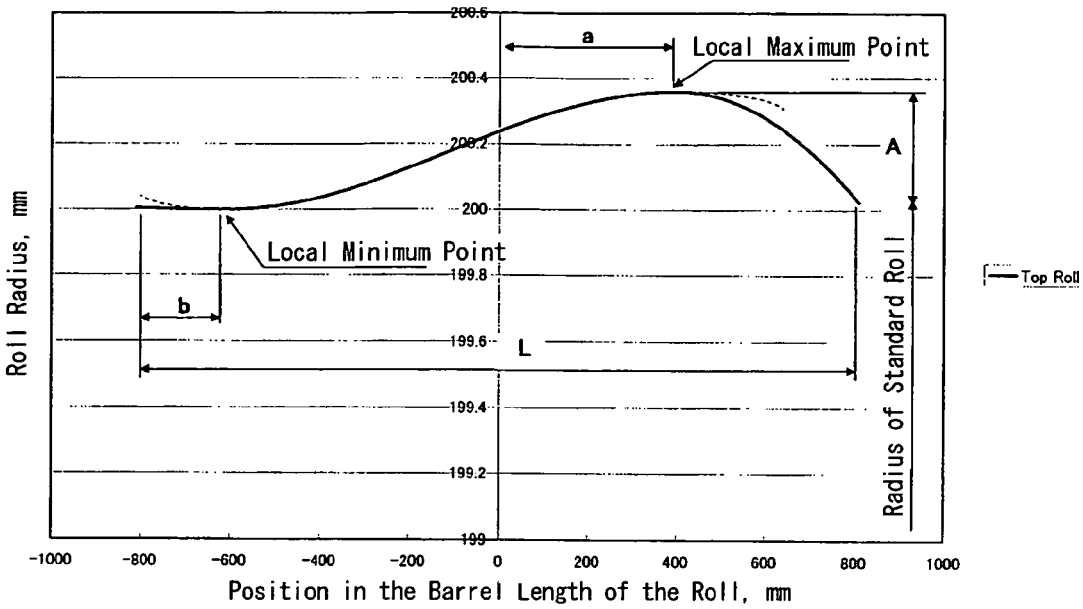
Fig. 2 [New Art]
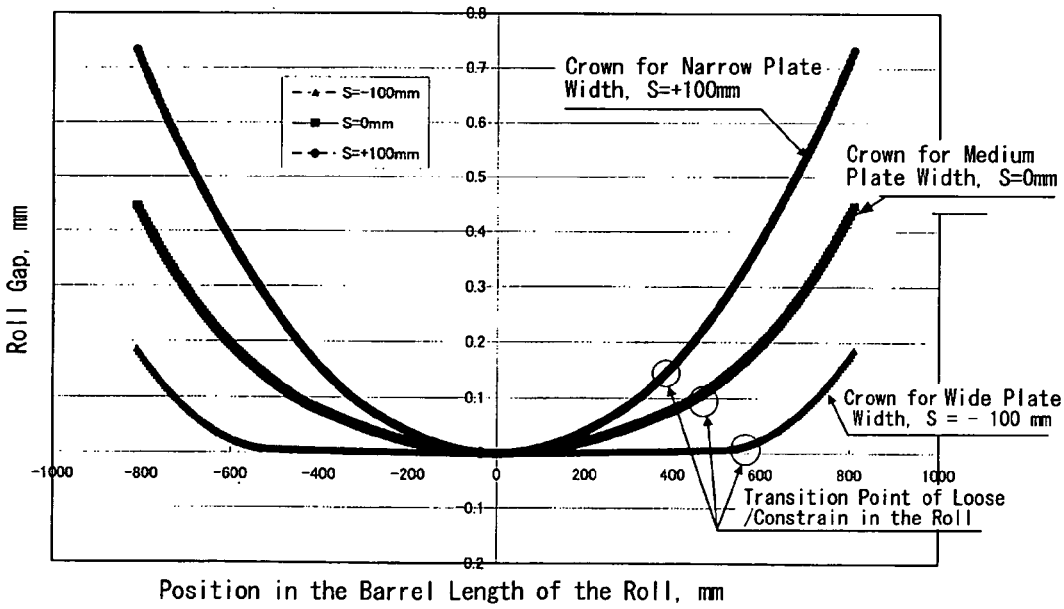

Fig. 3 [New Art]
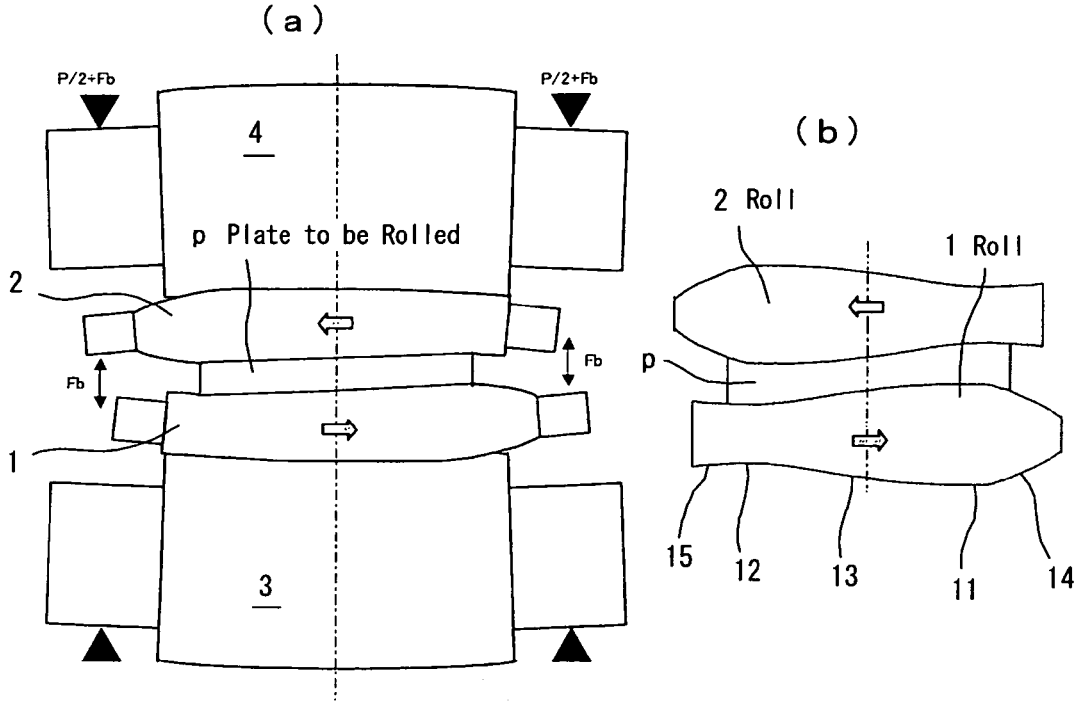
Fig. 4 [New Art]
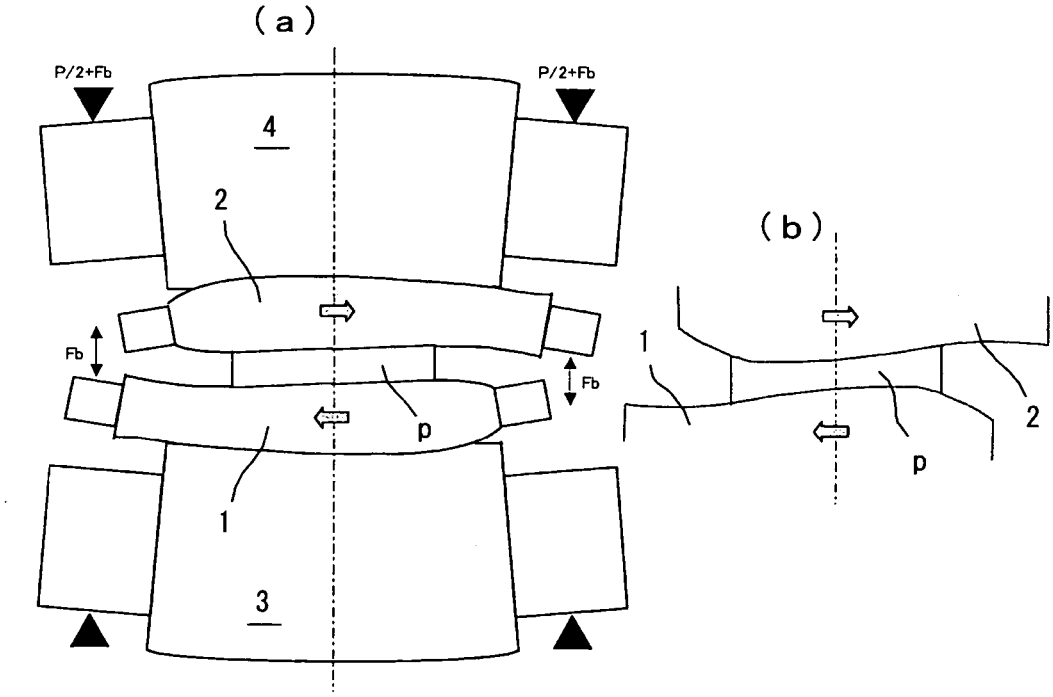

Fig. 5 [New Art]
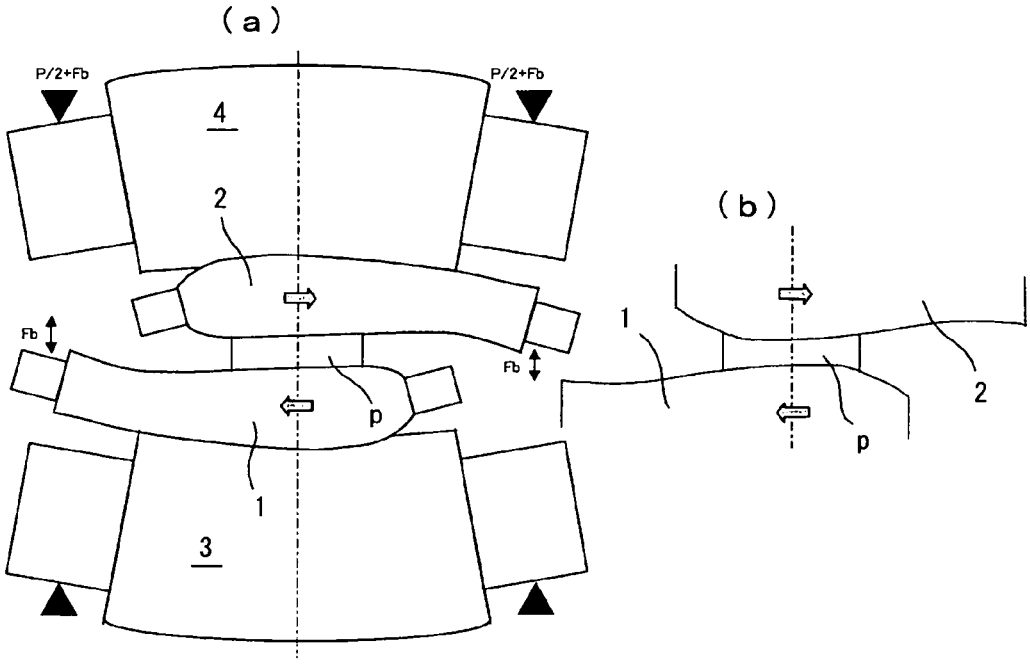
Fig. 6 [Known Art]
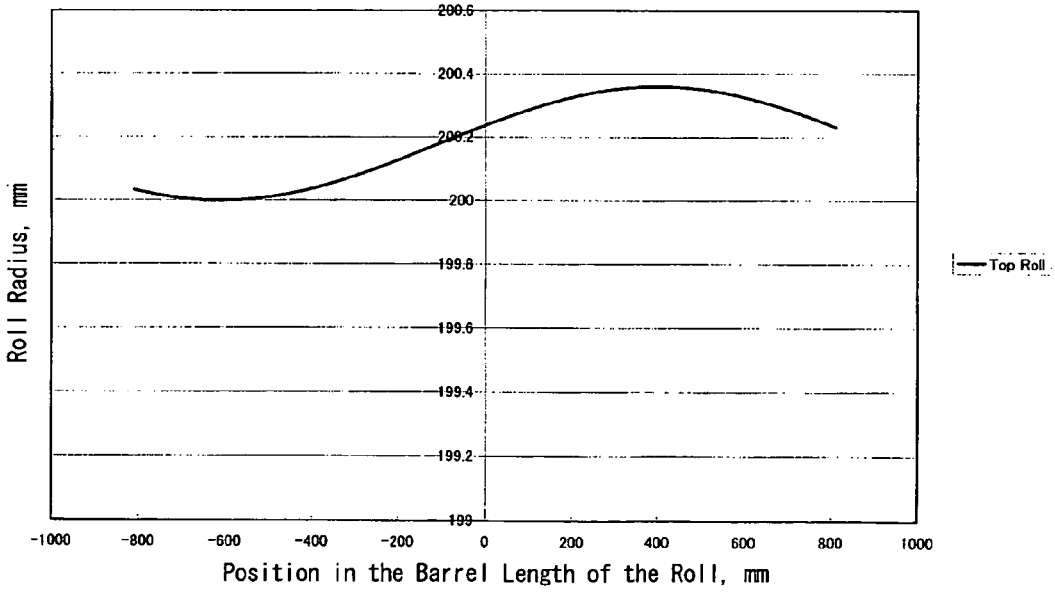

Fig. 7 [Known Art]
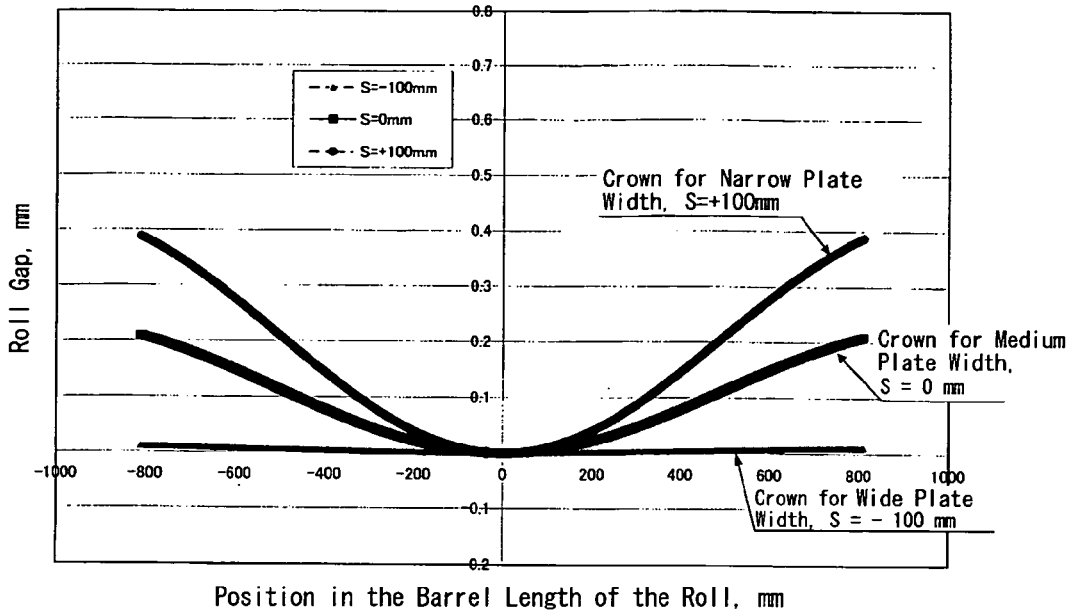

Fig. 8 [Known Art]
(a)
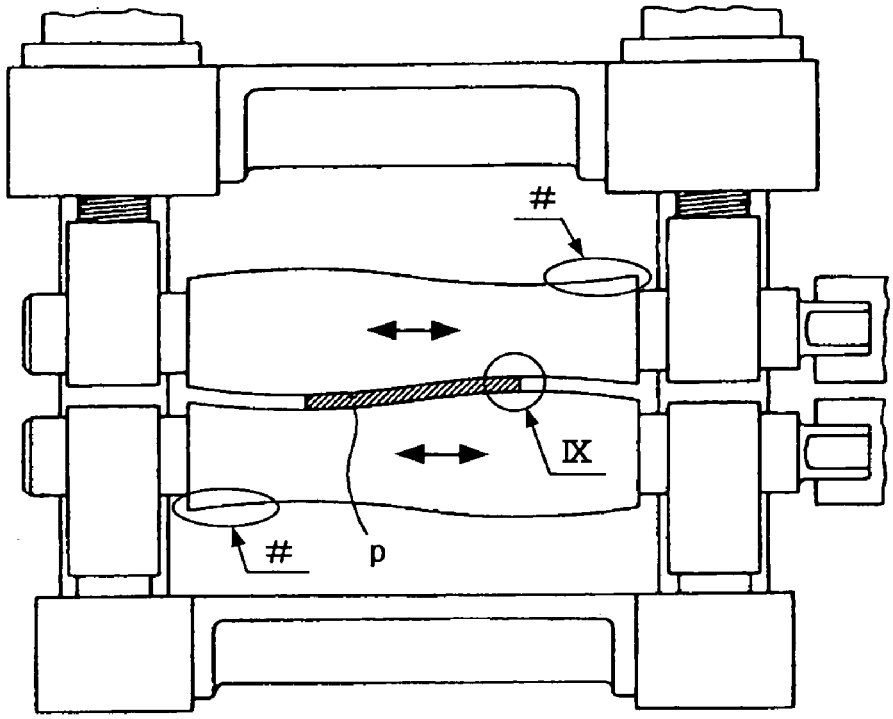
(b)
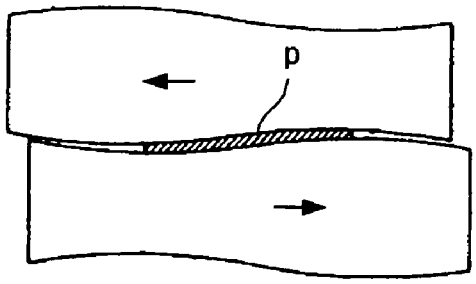
(c)
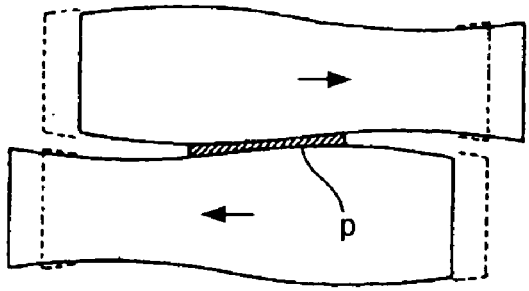

Fig. 9 [Known Art]
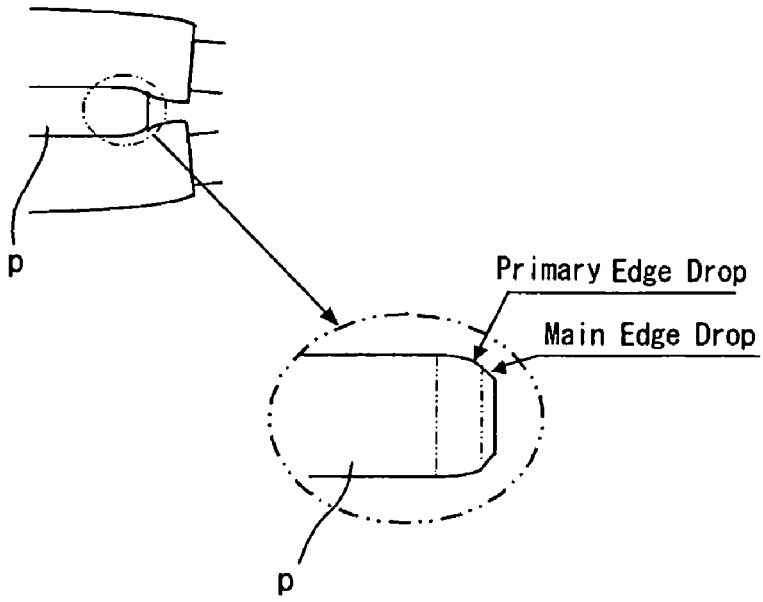

ROLL, ROLLING MILL AND ROLLING METHOD

TECHNICAL FIELD

The present invention relates to a roll, a rolling mill and a rolling method, in rolling a metal plate as material, either in hot or cold processes, correcting the plate crown etc.

BACKGROUND OF THE INVENTION

When rolling metal plate by means of a rolling mill, the deflection of the roll caused by the rolling load may often generate the so-called plate crown: a phenomenon that the thickness of the part near the center (in the width direction) of the plate becomes greater than that of the part near the end (in the width direction) of the plate.

One of rolling mills capable of correcting the plate crown is disclosed in the patent document 1. The rolling mill has the upper and lower work-rolls (or intermediate rolls or backup rolls) which are provided with an S-shaped roll crown, which may be called CVC or others, on the periphery, as shown in FIG. 8, and the pair of rolls relatively move (or shift against each other) in the axial direction. The relative movement of the pair of rolls corresponding to the plate width, profile and others can varies a roll gap properly, as shown in FIGS. 8 (*a*)-8(*c*), thereby correcting the plate crown.

Another art of correcting the plate crown by means of the rolls in the similar roll-crown periphery is disclosed in the patent bibliography 2.

The rolls used in the rolling mills as described in the patent bibliography 1 and 2 have roll-crown curves or roll profiles, such as an example shown in FIG. 6. In other words, the whole curve of the roll-crown periphery in such rolls can be drawn as a simple curve of those functions as cubic function or sine function of the axial length of the roll (or the position in the barrel length). For the rolling mill which uses work-rolls with such roll-crown curve, the gaps between the rolls at the surface are distributed as shown in FIG. 7. If the width of the metal plate as material is the narrower, the rolls near the center will receive the heavier load and the more deflection, hence the shift length for the rolls should be increased in the direction as shown in FIG. 8 (*c*) (a plus shifting (S>0)). On the other hand, if the width of the metal plate material is the wider, the rolls will receive widely distributed load and the deflection will be the less, hence the shift length for the rolls should be increased in the reverse direction as shown in FIG. 8 (*b*) (a minus shifting (S<0)). Thus the proper shift amount of the rolls varies according to the plate material widths, and the settings of the roll-gaps should be adjusted according to the plate product widths as shown in FIG. 7.

The other example of correcting method of the plate-crown is the art shown in the patent bibliography 3. This bibliography describes (particularly as shown in FIG. 2) a six-high mill, or so-called an HC mill or others, which has a pair of flat (without roll-crowns) rolls, as the upper and lower intermediate rolls, and they are mobile in their axial directions. By moving these intermediate rolls in their axial directions, the edges of the flat rolls will be positioned at the end of the plate product to enhance the bending effectiveness in the work-rolls, thereby correcting the plate-crown.

Another example of such mill, applying rolls with an S-shaped roll-crown in place of the flat rolls above-mentioned, is shown in the bibliography 4.

In addition, the patent bibliography 5 describes other method of rolling, using the work-rolls shaped convergent or taper-ground at one end of the flat rolls without roll-crown, positioning this convergent part to one side of the plate material to be rolled. This bibliography states that this method reduces the contact pressure between such convergent part and the plate material so that the edge-drops, which will be explained below, at the edge of the plate are reduced.

Patent Bibliography 1: JP A S57-91807
Patent Bibliography 2: JP A 2001-252705
Patent Bibliography 3: JP B S62-10722
Patent Bibliography 4: JP A S63-30104
Patent Bibliography 5: JP A S55-77903

DISCLOSURE OF THE INVENTION

Problems To Be Solved

The arts in the patent bibliographies 1 and 2 may correct the plate crown through the action by the roll crown, but will not correct the plate edge state such as the edge-drop (a phenomenon in the plate that the edge hangs down to lose the corner and the plate thickness becomes thinner.) In other words, if proper roll-crown is given to the work-roll in the axial direction, the plate crown is corrected over the whole range of the plate in the lateral direction, as shown in FIG. 8. However, the edge drop at the edges of the plate width is inevitable because of the local constraint by the work-rolls, as shown in FIG. 9. In addition, when backup rolls are used, the end part of the work-rolls are in contact with, and constrained by, the backup rolls, therefore, it is impossible to correct the plate crown by exerting a strong roll bending. Moreover, since one end of the S-shaped roll crown has a part of increasing roll diameter (the part shown as # of FIG. 8), the line contacting pressure against the backup rolls in a four-high mill or a six-high mill may increase excessively to cause a local spalling etc. which may damage the roll and shorten the roll life.

The art of the patent bibliography 3 or 4 can effectively bend the roll because the end of the roll is not constrained, however, when rolling, the intermediate roll and other rolls are in contact with each other in a short range to cause the increase of the line pressure between rolls; as a result, it is predicted that the roll damage such as spalling easily occurs. When a roll crown is not provided (the cited bibliography 3), disadvantageously the capability of correcting the plate crown is not sufficiently performed.

The art of the patent bibliography 5 is effective to decrease the edge drop but has a lower capability of correcting the crown over the entire plate width; therefore, in order to sufficiently correct the plate crown it is necessary to prepare other means such as an intermediate roll having an S-shaped roll crown, or a high-capacity bender, etc.

The invention according to the claims provides a roll, a rolling mill and a rolling method capable of not only effectively correcting the plate crown of a material to be rolled but also reducing the edge drop and preventing a roll from damage caused by the increase of the local line pressure between the rolls.

Means to Solve the Problems

Rolls of the invention according to the claims are characterized in that:

- Roll crown periphery is formed by a continuous curve (a curve continuously smooth overall) with a local maximum point and a local minimum point;
- The central region of the curve between the local maximum point and the local minimum point represents one function; and
- The end region of the curve from the local maximum point to the nearer roll end represents another function having an inclination of steeper gradient (or having a radius decreasing more sharply toward the roll end) than that of the extension of the function in the central region.

Regarding this roll, when a pair of such rolls is disposed to the upper and lower positions point-symmetric in the same plane as shown in FIG. 3(*b*), a continuously varying roll gap is formed between the central regions between the local minimum point and the local maximum point (the curving part representing one function mentioned above), which functions for the control of the crown. That is, as well as the rolling mill illustrated in FIG. 8, proper determination of the axial, relative position of the pair of rolls can determine the proper roll gap and correct the plate crown.

On the other hand, in the end region from the local maximum point to the nearer roll end, a curving part with a radius more sharply decreasing toward the end of the roll is formed by the function having an inclination of steeper gradient than that in the central region. Consequently an enlarged gap is generated in this region, which continues to the roll gap formed in the central region described above. In this end region, the constraining force (or contact strength) between the roll and the material to be rolled or other roll (any of the work-roll, intermediate roll and backup roll) is loosened; therefore, positioning the end in the width direction of the material to be rolled in this end region can reduce the edge drop regarding the material to be rolled and also exert a sufficient roll bending on the material to be rolled. It should be noted that the roll according to the claims, which is used as the work-roll in FIGS. 3(*a*), 3(*b*), etc., can loosen the constraining force in the same region and exert the same effect also when used as the intermediate roll of a six-high mill and the backup roll of a four-high mill or six-high mill.

As described above, the use of the roll can not only correct the plate crown properly but also reduce the edge drop at the same time, and exert a roll bending effectively according to need.

It should be noted that as the roll adapts the curve having a local maximum point and local minimum point, it is possible, when a material to be rolled has a wide width, to realize a zero crown having an even roll gap over the entire range in the width direction (indicated by "Crown for Wide Width, S=−100 mm" in FIG. 2, for example: the roll gap is even over almost the entire range of the plate width of 1200 mm) and a minus crown having a roll gap smaller toward the end of the plate in the width direction, contrary to the general. As a result, the roll can correct the plate crown properly under variety of rolling conditions in a wide range.

Further, in the roll of the invention, it is preferable that:

in the end region from the local minimum of gentler gradient than that of the extension of the function in the central region (that is, a function having a radius increasing more gently toward the roll end or having a constant radius).

Regarding this roll, the end region from the local minimum point to the nearer roll end has a curving part with a gently increasing radius toward the roll end, which is formed by a function having an inclination of gentler gradient than that of the function in the central region. Because of the gently increasing radius, the line contacting pressure against the other rolls around this region hardly increases excessively. Therefore, the inconvenient events such as occurring of spalling and other local damage of the roll and the exchange of rolls in a short term are avoidable. It should be noted that also this action applies to every case that the roll of the invention is used as the work-roll, intermediate roll or backup roll of a rolling mill.

With regard to the roll of the invention, it is preferable that:

the central region represents (a curve of) a cosine function and the end region from the local maximum point or the end region from the local minimum point also represents (a curve of) a quadratic function, for example.

The curve of a cosine function has smoothness and a local maximum point in the specific range and further has an inflection point in the middle of them. When a pair of rolls is disposed in such a position that the roll crown formed like this is point-symmetrical regarding the cross-sectional center of the material to be rolled, and moved relatively in the axial direction, a roll gap suitable for correcting the plate crown can be made between the roll crowns. This is because in the case the rolls are disposed and moved in this way, the roll gap becomes a sine function generating an inflection point between the central part and the end part of the plate and thereby effectively and strongly correcting the plate crown up to the central part of the plate width. If a cubic function is adopted to the central region of the upper and lower rolls as general, the roll gap represents a quadratic equation having a gentle curve over the entire length with no inflection point: therefore the adoption of a cosine function is advantageous for strongly correcting the plate crown. In addition, it is easy to smoothly and continuously connect a cosine function and a quadratic function at the local maximum point and the local minimum point.

A rolling mill of the invention according to the claim is capable of correcting the crown of a material to be rolled by relatively moving a pair of upper and lower rolls in the axial direction which are respectively provided with a roll crown and point-symmetrical regarding the cross-sectional center of the material to be rolled, and characterized in that any of the rolls described above is disposed as the pair of rolls (a pair of work-rolls, intermediate rolls or backup rolls).

By the action of the rolls mentioned above, the rolling mill can properly correct the plate crown and reduce the edge drop. Further the roll bending can be effectively executed; therefore the rolling mill has a considerably high capability of correcting the plate crown. Since the inconvenient increase of the line contacting pressure with other rolls is avoidable, damage to the roll due to spalling etc. hardly occurs.

Regarding such a rolling mill, particularly it is preferable that the roll is disposed as a pair of work-rolls. Because by forming the roll crown on the work-roll which contacts with a material to be rolled, the work-roll can directly exert the function of correcting the plate crown and of reducing the edge drop on the material to be rolled and bring about the remarkable effects. Even when the rolling load is small, the function acts easily too.

Otherwise, it is also preferable that the roll is disposed as a pair of intermediate rolls. In this case also, the rolling mill has the proper roll gap formed between the work-rolls according to the roll crown of the roll and further has the part of the enlarged gap where the constraining force is loosened, thereby exerting the function of correcting the plate crown and reducing the edge drop. In the case where the roll is disposed as the intermediate roll like this, further advantageously the roll bending can be effectively exerted on the work-roll.

It should be noted that the roll can be disposed also as a pair of backup rolls. This case also has the same merits as described above and in particular further has the following effect: since a flat and plane roll can be used as the work-roll, the surface properties of a material to be rolled is easily heightened; therefore it is easy to answer the required quality as a four-high mill for aluminum plate and raw tinplate and other mills. Moreover, since the roll is generally applied to the backup roll of a four-high mill, advantageously the number of rolls is less than that of a six-high mill.

Regarding the rolling mill of the invention mentioned above, the work-roll or the intermediate roll is preferably provided with a bending mechanism. Whether the roll (work-roll or intermediate roll) to be provided with the bending mechanism has the roll crown described above is not a problem.

Bending the work-roll or intermediate roll by the bending mechanism can compensate the apability of the roll crown to correct the plate crown. In detail, even when the roll gap is set by determining the axial, relative position of the pair of rolls having the roll crown, occasionally the plate is not sufficiently corrected according to the properties of a material to be rolled and the amount of rolling load corresponding to it: in these cases, exerting roll bending on the work-roll or intermediate roll by the bending mechanism can correct the plate crown more properly.

Regarding the rolling mill of the invention, particularly it is preferable that the function in the central region and the function from the local maximum point to the nearer roll end are determined so that: when the axial, relative position of the pair of rolls is determined so as to form a roll gap corresponding to the plate width of the material to be rolled (that is, a roll gap suitable to correct the plate crown regarding the material to be rolled with the plate width) by using the pair of rolls, the end region from the local maximum point to the nearer roll end of the roll crown is positioned to one of the upper and lower positions holding the end of the width direction of the material to be rolled. It should be noted that the pair of rolls can be the work-rolls, the intermediate rolls of a six-high mill and the backup rolls of a four-high mill or six-high mill.

According to this rolling mill, when the relative position of the pair of rolls in the axial direction is determined so as to be able to correct the plate crown corresponding to the plate width of the material to be rolled, the end region from the local maximum point to the nearer roll end is placed at the position holding the end of the width direction of the material to be rolled. As the end region has the enlarged gap as described above where the constraining force is loosened, the above positional relationship causes to reduce the edge drop at the end of the width direction of the material to be rolled and effectively bend the work-roll or intermediate roll. That is, the rolling mill can effectively reduce the edge drop at the same time when the relative position of the rolls is determined for correcting the plate crown. On the other hand, by simply placing the end region of the roll to one of the position holding the end of the width direction of the material to be rolled so as to reduce the edge drop, the relative position of the rolls in the axial direction is determined so as to form a roll gap suitable for correcting the plate crown corresponding to the plate width of the material to be rolled.

It should be noted that, when the axial, relative position of the rolls is determined, either of the upper or lower position holding the end of the width direction of the material to be rolled is preferably placed in the part having a proper amount (measurement) of the enlarged gap and the properly loosened constraining force. For this purpose, it is desirable to properly determine also the function with the inclination of steep gradient provided to the end region. In addition, it is further preferable to determine the function of the end region considering that the part where the constraining force is loosened is formed so that a necessary roll bending can be exerted corresponding to the amount of the rolling load.

A rolling method of the claim is characterized by using the rolling mill described above to roll after relatively move the rolls each other in the axial direction so that the end region from the local maximum point to the nearer roll end of the roll crown (in particular preferably the part having a proper amount of gap enlargement) is placed to one of the upper and lower positions holding the end of the width direction of a material to be rolled.

According to this rolling method, the proper rolling can be executed by simply determining the axial position of the roll in relation to the position of the end of the width direction of a material to be rolled as described above. Because when the axial position of the roll is determined in such a way, a proper roll gap capable of correcting the plate crown is formed between a pair of rolls; consequently both the correction of the plate crown and the reduction of the edge drop are executed at the same time. Unless the plate crown is sufficiently corrected when determining the axial position of the roll in this way, it is desirable to compensate the correction by bending the work-roll or intermediate roll.

BRIEF DESCRIPTION OF DRAWINGS

FIG. 1 shows a roll curve of the roll which is formed according to the invention;

FIG. 2 shows a roll gap distribution when the rolls with the curve of FIG. 1 are disposed in point-symmetric to the upper and lower positions and respectively shifted in the axial direction corresponding to the plate width;

FIG. 3(*b*) is an illustration showing the relative position of the rolls 1 and 2 and the roll gap distribution when the rolls 1 and 2 are shifted toward the minus direction in order to roll a material to be rolled p with a comparatively wide width, and FIG. 3(*a*) is an illustration showing the plate crown etc, while rolling;

FIG. 4(*b*) is an illustration showing the relative position of the rolls 1 and 2 and the roll gap distribution when the rolls 1 and 2 are shifted slightly toward the plus direction in order to roll a material to be rolled p with a medium width, and FIG. 4(*a*) is an illustration showing the plate crown etc, while rolling;

FIG. 5(*b*) is an illustration showing the relative position of the rolls 1 and 2 and the roll gap distribution when the rolls 1 and 2 are shifted toward the plus direction in order to roll a material to be rolled p with a considerably narrow width, and FIG. 5(*a*) is an illustration showing the plate crown etc, while rolling;

FIG. 6 shows a roll curve of a conventional roll;

FIG. 7 shows a roll gap when using the roll of FIG. 6;

FIG. 8 is an illustration showing a conventional rolling mill: FIG. 8(*a*) shows the zero-shifting state when a roll is not shifted in the axial direction, FIG. 8(*b*) shows the minus-shifting state, and FIG. 8(*c*) shows the plus-shifting state; and FIG. 9 is a conceptual view showing the edge drop of a material to be rolled p easily occurring in a conventional rolling mill.

EXPLANATIONS OF LETTERS OR NUMERALS

1 and 2: Roll
3 and 4: Backup Roll
11: Local Maximum Point
12: Local Minimum Point
13: Central Region
14: End Region (from the Local Maximum Point)
15: End Region (from the Local Minimum Point)
P: Material to Be Rolled Description of Preferred Embodiment As one embodiment of the invention, a rolling mill using the roll of the invention as a pair of work-rolls in a four-high mill is shown in FIG. 1-FIG. 5. FIG. 1 shows a roll curve of the roll 1 and 2 (See FIG. 3, for example) which is formed according to the invention. FIG. 2 is a chart showing a roll gap distribution between the rolls and 2 when the rolls and 2 with the curve of FIG. 1 are disposed in point-symmetric to the upper and lower positions and each roll 1 and 2 is shifted in the axial direction toward the minus and toward plus direction (the shifting amount S=−100 mm, 0 mm, +100 mm) corresponding to the plate width. FIG. 3 is an illustration showing the relative position of the rolls 1 and 2 and the roll gap distribution when the rolls 1 and 2 are shifted toward the minus direction in order to roll a material to be rolled (a steel plate) p with a comparatively wide width (FIG. 3(*b*)) and is an illustration showing the plate crown etc, while loaded by the rolling mill (FIG. 3(*a*)). FIGS. 4(*a*) and 4(*b*) are illustrations showing the same when the rolls 1 and 2 are shifted slightly toward the plus direction in order to roll a material to be rolled p with a medium width; and FIGS. 5(*a*) and 5 (*b*) are illustrations showing the same when the rolls 1 and 2 are shifted largely toward the plus direction in order to roll a material to be rolled p with a considerably narrow width.

While the illustrated rolling mill is a four-high mill where the backup rolls 3 and 4 with a large diameter are arranged in the back of the work-rolls adapting the rolls 1 and 2, it is obvious that the invention is not to be considered limited to it.

In the barrel of the roll 1 and 2, a roll crown comprising a continuous curve having a local maximum point and a local minimum point is formed as shown in FIG. 1. However, the relation between the roll radius and the barrel length of the roll at each point of the roll crown is determined by not one function over the entire barrel length but three functions each of them being adapted to the different region of the barrel divided into three regions as follows: a) the central region from the local minimum point and the local maximum point adapting a cosine function including the local minimum point and the local maximum point; b) the end region from the local maximum point to the nearer roll end illustrated in the right side of FIG. 1 adapting a quadratic function with an inclination of steeper gradient than that according to the cosine function (or the inclination illustrated by the broken line); and c) the end region from the local minimum point to the nearer roll end illustrated in the left side of FIG. 1 adapting a quadratic function with an inclination of gentler (almost zero) gradient than that according to the cosine function (or the inclination illustrated by the broken line).

The local maximum point, the local minimum point, the central region, the end region (from the local maximum point) and the end region (from the local minimum point) of FIG. 1 are indicated respectively by reference letters 11, 12, 13, 14 and 15 in the roll 1 of FIG. 3(*b*).

When a pair of rolls 1 and 2 is disposed to the upper and lower position point-symmetrical in the same plane, for example as shown in FIG. 3, and determined each relative position in the axial direction properly, a proper roll gap is formed between the rolls 1 and 2 by the central region 13 of the roll crown, and thus it becomes possible to properly correct and flatten the plate crown of a material to be rolled p. The roll gap distribution viewed from the width direction of the material to be rolled p when the relative position of the rolls 1 and 2 is determined corresponding to each plate width is shown in FIG. 2; and the rough form (or the exaggerated illustration) of the roll gap in that case is shown in FIG. 3(*b*)-FIG. 5(*b*). The narrower the width of the metal to be rolled p is, the more concentrically the rolls 1 and 2 are loaded and more easily deflected; therefore the roll gap is formed so that the part near the center is smaller than the end in the width direction.

As the rolls 1 and 2 have, in the end region 14 from the local maximum point 11 to the nearer roll end, the inclined part where the roll radius decreases sharply, a part where the roll gap, illustrated in FIG. 2, FIG. 3, etc., is enlarged or a loose-constraining part in other words is formed from the local maximum point 11 to the roll end. In the upper and lower positions of the end region 14, the loose-constraining part exists between the rolls 1 and 2 and the material to be rolled p and also between the rolls 1 and 2 and the backup rolls 3 and 4, where the contacting pressure with each other gradually decreases toward the roll end. Since the constraint of the material to be rolled p is loosened, when placing the end (edge) of the width direction of the material to be rolled p, it is possible to effectively reduce the edge drop. Further in this part, the constraint of the work-roll (or the intermediate roll when the rolling mill is a six-high mill) is loosened; therefore, it is possible to exert sufficient roll bending on the roll to correct the plate crown more properly.

However, as the constraint in the loose-constraining part dose not sharply decreases to zero at the roll end, the line pressure between rolls in other part is prevented from excessively increasing to cause spalling and other damage of the roll. Moreover, because of the same reason, the mill modulus and lateral rigidity of the mill are prevented from decreasing with shifting of the roll.

The rolls 1 and 2 also have the part with an inclination of gentle gradient in the end region 15 from the local minimum point 12 to the nearer roll end. Accordingly, even when rolling is done as shown in FIGS. 3(*a*) and 3(*b*) for example, the line contacting pressure between the rolls 1 and 2 and the backup rolls 3 and 4 is prevented from increasing excessively near the end region 15 and the inconvenience that the roll is easily damaged due to spalling etc. is avoidable.

In order to properly correct the plate crown and reduce the edge drop of the material to be rolled p, it is necessary to hold almost entire width of the material to be rolled p with the central region 13 in the barrel of the rolls 1 and 2 and to hold the edge part of the material to be rolled p with the loose-constraining part continuing to the local maximum point 11. However, proper selection of the function which determines the curve of the central region 13 makes the edge part naturally held with the loose-constraining part when the axial, relative position of the rolls 1 and 2 is determined corresponding to the plate width. Because in the case the roll crown in the central region 13 is properly formed by a preferable function, it is possible to correct the plate crown of the material to be rolled p by shifting the rolls 1 and 2 in the axial direction a) to increase the horizontal distance between each local maximum point 11 of the rolls 1 and 2 when the plate width is large (See FIG. 3), or b) to decrease the horizontal distance so as to bring the outwardly convex part of the roll curve close to each other when the plate width is narrow. In each case, if the function is set so that the edge part of the material to be rolled p is preferably positioned to just outside of the local maximum point 11 (or the end region), the rolls 1 and 2 are able to be used to correct the plate crown and also reduce the edge drop.

EXAMPLE

The following description is an example of the roll curve shown in FIG. 1.

Let L be a barrel length, a the distance of the local maximum point from the center of the barrel length of the roll, b the distance of the local minimum point from the end of the barrel length of the roll, and A the difference of the radius of the local maximum point and the local minimum point.

When the roll radius f (X') on each point of the surface is composed of a cosine function with amplitude A between the local minimum point and the local maximum point, the roll curve between them is represented by the equations (*a*) and (2) such as:

$$X'=\pi/(L/2+a-b)*(X-b) \quad (1)$$

$$f(X')=-A/2*\mathrm{COS}\,(X')+R0 \quad (2)$$

R0: Standard roll radius

X represents the arbitrary axial position from the end of the roll barrel, but in FIG. 1 the center is regarded as 0 for convenience of illustrating.

The region from the end of the roll barrel to the local minimum point represents the following quadratic equation with an inclination of gentler gradient than that of the curve represented by the equations (1) and (2):

$$0 \leqq X \leqq b$$

$$f(X)=c\,(X-b)^2+R0-A/2 \quad (3)$$

Here, c is a constant to determine the gentleness of the curve.

While, the region from the local maximum point to the nearer end of the roll barrel represents the following quadratic equation with an inclination of steeper gradient than that of the curve represented by the equations (1) and (2):

$$L/2+a \leqq X \leqq L$$

$$f(X)=-d\,(X-L/2-a)^2+R0+A/2 \quad (4)$$

Here, d is a constant to determine the steepness of the curve.

The roll curve described above is applied to the work-roll of a four-high mill for rolling the plate of 4 feet width.

FIG. 1 shows the roll curve obtained when the barrel length of the backup roll is 1420 mm, the barrel length of the work-roll L=1620 mm, the standard roll radius R0=200 mm, a=400 mm, b=200 mm, c=1.33E−7 and d=2.00E-6. This roll is used for the upper work-roll and a curve of point-symmetric with the roll regarding the cross-sectional center of the plate is disposed to the lower work-roll. Regarding the roll gap equivalent to the distance between the upper work-roll and the lower work-roll, the curve shown in FIG. 2 is obtained by relatively shifting the rolls by ±100 mm in the axial direction.

As shown in FIG. 2, at the roll shifting position making a crown for wide width (S=−100 mm), a loose-constraining part of the roll is found near the end of the plate of about 1200 mm width. Also at the roll shifting position making a crown for medium width (S=0 mm), a loose-constraining part of the roll is found near the end of the plate of about 1000 mm width; and at the roll shifting position making a crown for small width (S=+100 mm), near the end of the plate of about 900 mm width.

On the other hand, the roll curve where the barrel length of the roll is uniformly represented by a cosine function, which is one of the conventional arts, is shown in FIG. 6 and the roll gap formed with it is shown in FIG. 7. Here, the same maximum value and minimum value is used as in the present invention for comparison to the present invention.

As will be noted from FIG. 2 and FIG. 7, in this invention, when the upper and lower rolls are relatively moved in the axial direction to the roll position for obtaining a roll crown according to the plate width, a loose-constraining part of the roll is automatically generated in the roll gap near the end of the plate width. Consequently, the end of the plate width is constrained in a better condition that makes it possible to correct the plate crown and has potential at the same time for improving the bending effect and for the edge drop reducing effect.

Industrial Applicability

As described above, the roll, rolling mill and rolling method of the invention is effectively applicable in the industrial field executing hot or cold rolling of a metal plate as a material to be rolled.

What is claimed is:

1. A rolling mill roll, of a metal plate rolling mill, the roll being provided with a roll crown formed on a periphery of the roll, wherein the roll crown is defined by a continuous curve having a single local maximum point and a single local minimum point at positions respectively closer to first and second ends of the roll in an axial direction of the roll, the continuous curve consists of a central curve region between the local maximum point and the local minimum point, a first end curve region between the local maximum point and the first end, and a second end curve region between the local minimum point and the second end, the central curve region is expressed by a central function that renders a single inflection point between the local maximum point and the local minimum point, the first end curve region is expressed by a first end function that renders a steeper gradient than that of an extension expressed by the central function, and the second end curve region is expressed by a second end function that renders a gentler gradient than that of an extension expressed by the central function.

2. The roll according to claim 1, wherein the central function is a cosine function, the first end function is a quadratic function, and the second end function is another quadratic function.

3. A metal plate rolling mill comprising:

an upper mill mechanism including an upper rolling mill roll; and a lower mill mechanism including a lower rolling mill roll, the upper and lower mill mechanisms being arranged to form a roll gap therebetween a process object consisting of a metal plate, wherein the upper and lower rolling mill rolls respectively comprise roll crowns formed on peripheries of the rolls, where are arranged in point-symmetry regarding a cross-sectional center of the process object, to correct a crown of the process object by shifting the upper and lower rolling mill rolls relative to each other in an axial direction, the roll crown of each roll of the upper and lower rolling mill rolls is defined by a continuous curve having a single local maximum point and a single local minimum point at positions respectively closer to first and second ends of the roll in an axial direction of the roll, the continuous curve consists of a central curve region between the local maximum point and the local minimum point, a first end curve region between the local maximum point and the first end, and a second end curve region between the local minimum point and the second end curve region between the local minimum point and the second end, the central curve region is expressed by a central function that renders a single inflection point between the local maximum point and the local minimum point, the first end curve region is expressed by a first end function that renders a steeper gradient than that of an extension expressed by the central function, and the second end curve region is expressed by a second end function that renders a gentler gradient than that of an extension expressed by the central function.

4. The rolling mill according to claim 3, wherein the upper and lower rolling mills rolls are a pair of work rolls that form the roll gap therebetween.

5. The rolling mill according to claim 3, wherein the upper and lower mill mechanisms include a group of rolls arranged to provide a pair of work rolls that form the roll gap therebetween, a pair of intermediate rolls disposed outside the pair of work rolls, and a pair of backup rolls disposed outside the pair of intermediate rolls, and the upper and lower rolling mill rolls are the pair of intermediate rolls.

6. The rolling mill according to claim 3, wherein the upper and lower mill mechanisms include a group of rolls arranged to provide a pair of work rolls that form the roll gap therebetween and a pair of backup rolls disposed outside the pair of work rolls, and the upper and lower rolling mill rolls are the back-up rolls.

7. The rolling mill according to claim 3, wherein axial relative position of the upper and lower rolling mill rolls are set in accordance with a plate width of the process object such that the first end curve regions of the roll crowns of the upper and lower rolling mill rolls are respectively present at opposite ends of the process object in a width direction of the process object.

8. A metal plate rolling mill comprising:

an upper mill mechanism including an upper work roll; and a lower mill mechanism including a lower work roll, the upper and lower mill mechanisms being arranged to form a roll gap between the upper and lower work rolls to process a process object consisting of a metal plate, wherein the upper and lower work rolls respectively comprise roll crowns formed on peripheries of the rolls, which are arranged in point-symmetry regarding a the cross-sectional center of the process object, to correct a crown of the process object by shifting the upper and lower work rolls relative to each other in an axial direction, the roll crown of each roll of the upper and lower work rolls is defined by a continuous curve having a single local maximum point and a single local minimum point at positions respectively closer to first and second ends of the roll in an axial direction of the roll, the continuous curve consists of a central curve region between the local maximum point and the local minimum point, a first end curve region between the local maximum point and the first end, and a second end curve region between the local minimum point and the second end, the central curve region is expressed by a central function that renders a single inflection point between the local maximum point at the local minimum point, the first end curve region is expressed by a first end function that renders a steeper gradient than that of an extension expressed by the central function, and the second end curve region is expressed by a second end function that renders a gentler gradient than that of an extension expressed by the central function.

9. The rolling mill according to claim 8, wherein axial relative position of the upper and lower work rolls are set in accordance with a plate width of the process object such that the first end curve regions of the roll crowns of the upper and lower work rolls are respectively present at opposite ends of the process object in a width direction of the process object.

10. The roll according to claim 1, wherein the first end function is set to have a radius of the roll corresponding to the first end curve region decrease more sharply at a position closer to the first end.

11. The rolling mill according to claim 3, wherein the first end function is set to have a radius of the roll corresponding to the first end curve region decrease more sharply at a position closer to the first end.

12. The rolling mill according to claim 3, wherein the central function is a cosine function, the first end function is a quadratic function, and the second end function is another quadratic function.

13. The rolling mill according to claim 8, wherein the first end function is set to have a radius of the roll corresponding to the first end curve region decrease more sharply at a position closer to the first end.

14. The rolling mill according to claim 8, wherein the central function is a cosine function, the first end function is a quadratic function, and the second end function is another quadratic function.

* * * * *